US005258751A

United States Patent [19]

DeLuca et al.

[11] Patent Number: 5,258,751

[45] Date of Patent: Nov. 2, 1993

[54] METHOD OF PRESENTING MESSAGES FOR A SELECTIVE CALL RECEIVER

[75] Inventors: Joan S. DeLuca, Boca Raton; Amy R. Kabcenell, Highland Beach; Richard E. Johnson, Boynton Beach, all of Fla.

[73] Assignee: Motorola, Inc., Schaumburg, Ill.

[21] Appl. No.: 787,463

[22] Filed: Nov. 4, 1991

[51] Int. Cl.[5] ..... G08B 5/22

[52] U.S. Cl. ..... 340/825.44; 455/38.4

[58] Field of Search ..... 340/825.44, 825.45, 340/825.46, 825.47, 825.48, 311.1, 799, 802; 455/38.4

[56] References Cited

U.S. PATENT DOCUMENTS

| | | | |
|---|---|---|---|
| 4,639,723 | 1/1987 | Boughton | 340/825.44 |
| 4,769,642 | 9/1988 | Davis et al. | 340/825.44 |
| 4,873,520 | 10/1989 | Fisch et al. | 340/311.1 |
| 4,949,085 | 8/1990 | Fisch et al. | 340/311.1 |
| 4,965,569 | 10/1990 | Bennett et al. | 340/825.44 |
| 4,988,991 | 1/1991 | Motegi | 340/825.44 |

OTHER PUBLICATIONS

Motorola, Product Brochure, 1987, "PMR 2000–Personal Message Receiver".

*Primary Examiner*—John K. Peng
*Assistant Examiner*—Andrew Hill
*Attorney, Agent, or Firm*—Jose Gutman; Daniel R. Collopy; Thomas G. Berry

[57] ABSTRACT

A selective call receiver (200) is capable of receiving messages and storing the messages for subsequent retrieval by a user. The selective call receiver (200) assigns a status designation (706) and a chronological order (704) to each stored message, and further prioritizes the messages in a sequential order being prioritized first by a priority of the status designation (706) assigned to the messages and then further prioritized therewithin according to the chronological order (704) assigned to the messages. The selective call receiver (200) then presents the messages to the user in the sequential order for the messages.

10 Claims, 6 Drawing Sheets

METHOD OF PRESENTING MESSAGES FOR A SELECTIVE CALL RECEIVER

FIELD OF THE INVENTION

This invention relates generally to selective call receivers, and more particularly to a method of presenting messages for a selective call receiver.

BACKGROUND OF THE INVENTION

Normally, a selective call receiver (e.g., a pager), upon receiving a message, stores the message in memory for review at a later time. Received messages are typically stored into message storage slots in memory organized sequentially in chronological order. For example, messages may be stored by their relative arrival sequence, such as in a first-in-first-out sequence where the oldest message is presented first to a user. Alternatively, the messages may be presented in a last-in-first-out sequence (i.e., in reverse chronological order), where the newest message is presented first to the user. A selective call receiver would present a sequence of received messages to the user in one of these ways, which the user must understand and logically follow.

Clearly, the number of message storage slots are limited by the available memory. For example, a selective call receiver may be capable of storing up to five messages before running out of memory. Thus, when the message storage slots are full (i.e., five messages are stored), new messages may be stored at the expense of deleting older messages. One such method currently used is to delete the oldest message to accommodate a newly received message. Unfortunately, if a user wishes to review an older message, it may have been automatically deleted.

Current integrated circuit technologies have increased memory capacity. As a result, selective call receivers can store more messages. This significantly reduces the need for automatically deleting messages. However, users tend to find it more difficult to retrieve or locate a desired message for the following reasons. First, the sheer number of stored messages increases beyond a manageable level. This makes it more difficult for users to keep track of stored messages. Second, users tend to randomly read and delete messages, and a newly received message is usually placed in the first available message storage slot. Hence, selective call receiver users may not be able to easily determine the time priority of the received messages or where the latest received message was stored.

For example, FIGS. 1A, 1B, and 1C show a display 100 for presenting messages to a user of a selective call receiver. This display 100 is representative of a display used in the Motorola PMR 2000 alphanumeric display message pager manufactured by Motorola, Inc. of Schaumburg, Ill. In that pager, up to sixteen messages can be stored and displayed. In this illustrative example, however, up to twelve messages are shown, being represented by up to twelve message indicators 102 on a status screen of the display 100. A pointer 103 indicates to the user which message is currently being selected for display. In this example, the pointer 103 is pointing to message one. By pushing buttons on the pager the user can advance the pointer 103 through the sequence of message indicators 102 displayed. In this way, the user can push buttons to point to a desired message and then to display the selected message.

The message indicator 102 representing a message stored in message storage slot number eleven is not blinking. This indicates to the user that the message was previously read by the user. On the other hand, the message indicator 104 representing a message stored in message storage slot number seven is blinking. This indicates that the message was not read. Additionally, a lock icon 106 corresponding to a message storage slot, such as message storage slot number two, indicates that the particular message has been protected and will not be overwritten when a new message is received. That is, the user typically considers this message important and protects the message for future reference. The protect status on the message guards against the message being automatically deleted by the pager when a new message is received. However, the user is capable of selectively deleting undesired messages from the pager memory. For example, message storage slot number three was previously deleted as indicated by the blank space 108 for the corresponding position on the status screen. In this way, each message stored in the pager is assigned an individual message status, such as "read message", "unread message", and "protected message".

The status screen in this example normally organizes the message indicators 102 from left to right in chronological order. The user then can advance the pointer 103 through the sequence to view the messages in a first-in-first-out sequence. However, as the user deletes messages and new messages are subsequently received, such as receiving new message 110 and then new message 120, the messages can be presented to the user in a non-chronological sequence. This makes it difficult for a user to understand the order of messages being presented and to distinguish between old and new messages.

In the previous example, the method used by the selective call receiver for presenting messages to the user can make it difficult for the user to keep track of stored messages. First, the chronological order of presenting messages can be corrupted. This is mainly due to the user randomly deleting or protecting individual messages. The selective call receiver would subsequently store new messages in the available message storage slots and present the messages out of sequence. Second, the messages being presented are not grouped in any particularly meaningful way. Message status categories, such as "read message", "unread message", and "read and protected message", are meaningful to the user. However, the messages being presented are not arranged to take advantage of these message categories. The messages are typically presented in some form of chronological order. Hence, when the chronological order is corrupted the user may find it difficult if not impossible to keep track of the stored messages. This problem is significantly aggravated as the number of stored messages increase.

Thus, what is necessary is a method for presenting stored messages that enables a selective call receiver user to quickly and easily determine the time priority and the organization of the messages stored in memory.

SUMMARY OF THE INVENTION

In carrying out one form of this invention, there is provided a selective call receiver, comprising a receiver for selectively receiving messages, and a memory coupled to the receiver for storing the messages. The selective call receiver comprises means coupled to the memory and to the receiver for assigning a chronological order to each of the messages stored in the memory based on an order in which the messages are received, and also for assigning a status designation, other than the chronological order, to the messages, and further for prioritizing the messages in a sequential order being prioritized first by a priority of the status designation assigned to the messages and then further prioritized therewithin according to the chronological order assigned to the messages. The selective call receiver can then present the messages to a user in the sequential order for the messages.

DESCRIPTION OF A PREFERRED EMBODIMENT

Figure 1A:
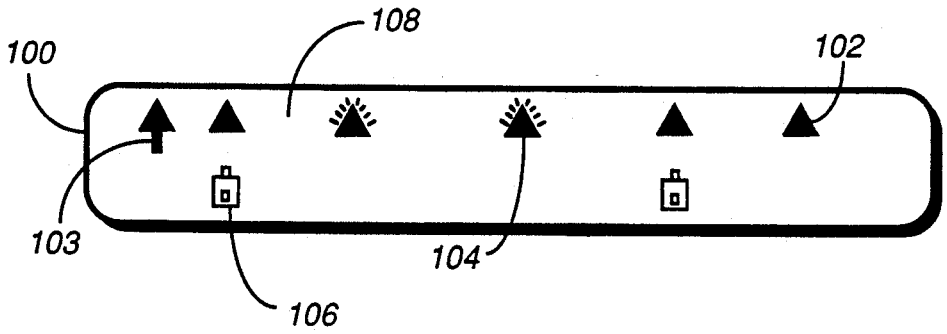
Prior Art FIG. 1A
FIGS. 1A, 1B, and 1C show different views of a display for a conventional selective call receiver.
Figure 1B:
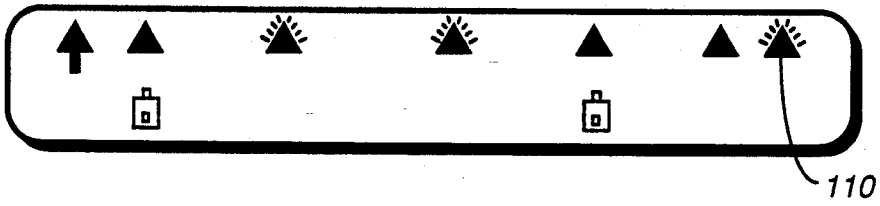
Prior Art FIG. 1B
Figure 1C:
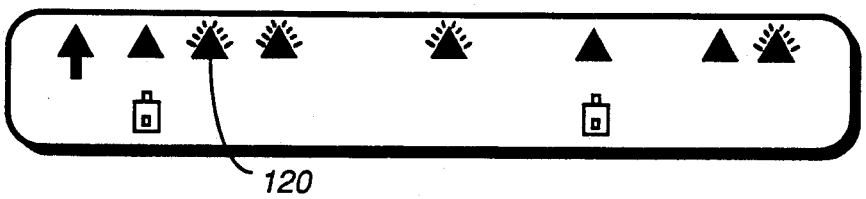
Prior Art FIG. 1C
Figure 2:
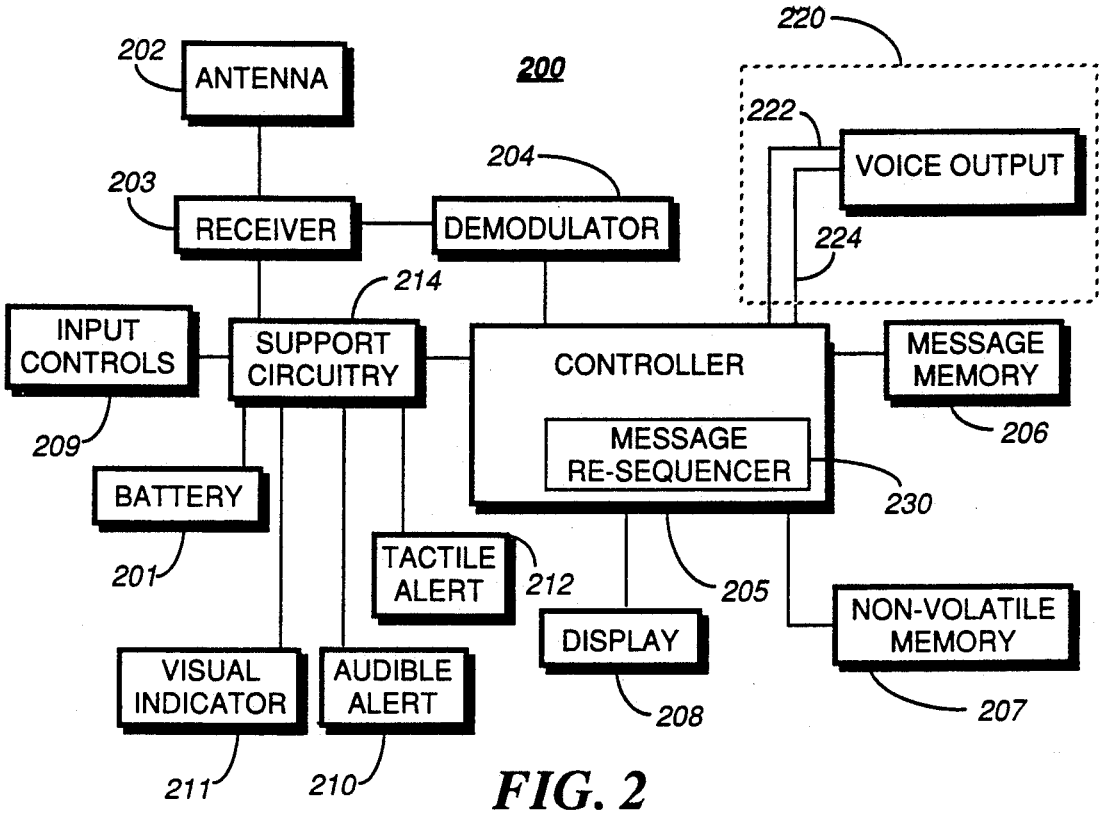
FIG. 2 shows a block diagram of a selective call receiver according to an embodiment of the present invention.

Referring to FIG. 2, a block diagram of a selective call receiver (e.g., a paging receiver) 200 is shown, according to an embodiment of the present invention. The selective call receiver 200 is powered by a battery 201 and operates to receive a radio frequency signal via an antenna 202. A receiver 203 is coupled to the antenna 202 to receive the radio frequency signal. A demodulator 204 is coupled to the receiver 203 to recover any information signal present in the radio frequency signal using conventional techniques. The recovered information signal from the demodulator 204 is coupled to a controller 205 which interprets and decodes the recovered information in a manner well known to those skilled in the art.

In the preferred embodiment, the controller 205 comprises a microcomputer, such as a Motorola, Inc. manufactured microcomputer (e.g., MC68HC05C4), and has a signal processor performing the function of a decoder, which is normally implemented in both hardware and software. The signal processor checks the recovered information signal for address information and correlates a recovered address with a predetermined address that is usually stored in the selective call receiver's non-volatile memory 207. When the addresses correlate, and in accordance with settings associated with user input controls 209, such as buttons or switches, the controller 205 normally stores a recovered message in a memory 206. The memory 206 comprises message storage slots for storing received messages, one message per slot. Preferably, the memory 206 is also non-volatile, such as being backed-up by the battery 201 when the selective call receiver is turned off. In this way, a user of the selective call receiver 200 is capable of retrieving stored messages during normal use, even when the selective call receiver 200 is turned off and then back on.

Subsequently, the selective call receiver 200 typically presents at least a portion of the stored message to a user, such as by a display 208 (e.g., a liquid crystal display). In one embodiment of the present invention, the display 208 is a graphical display capable of displaying icons that represent the stored messages. Each of the stored messages is represented by at least one icon, constituting a message indicator. The message indicator conveys status and chronological information to the user, as will be more fully discussed below.

Optionally, the selective call receiver 200 presents at least a portion of the received message to the user by way of an optional voice output module 220, using known methods and techniques. The optional voice output module 220 is coupled to the demodulator 204 through audio coupling circuits 222. The recovered voice audio signals are gated through the audio coupling circuits 222 under control of the controller 205. The controller 205 also controls the voice output module 220 via control circuits 224. In this way, a received voice message may be coupled to the user. Further, received voice messages may be digitally encoded and stored in the message memory 206, using known encoding methods. These voice messages may be subsequently decoded back to voice audio signals and played-back to the user. Hence, for this option, the selective call receiver can couple the received voice messages to the user contemporaneously with receiving the voice messages, or the voice messages may be stored in memory 206 and subsequently played back for the user. In the case where voice messages are stored for later retrieval by the user, the selective call receiver preferably conveys status information in chronological order to the user via the graphical display 208, as discussed above.

Usually, along with receiving the message, an audible alert indicator device 210 (e.g., a speaker or a piezoelectric transducer), a visual alert indicator device 211 (e.g., a lamp, a light emitting diode, or an icon representation on the display 208), a vibratory alert indicator device 212 (e.g., a tactile alerting device), or a combination of the aforementioned alert indicator devices alerts the user that a message has been received. For a display message, such as an alphanumeric display message or a numeric display message, the user then can view at least a portion of the message presented on the display 208 by activating the user input controls 209. For a voice message, as discussed earlier for the voice option, the voice message may be presented to the user via the voice output module 220. The voice message may be presented contemporaneously with receiving the voice message, usually after the alert to the user. Alternately, the voice message may be stored in memory 206 and presented to the user at a later time. The user can request playback of a stored voice message typically by activating the user input controls 209.

A support circuit 214 preferably comprises a conventional signal multiplexing integrated circuit, a voltage regulator and control mechanism, a current regulator and control mechanism, audio power amplifier circuitry, control interface circuitry, and display illumination circuitry. These elements are arranged to provide support for the functions of the selective call receiver 200 as may be requested by a user.

The controller 205 comprises a message re-sequencer 230, preferably implemented in the microcomputer hardware and software. The message re-sequencer 230 handles assigning chronological order to the stored messages to maintain a chronological sequence. Specifically, the message re-sequencer 230 assigns a relative age to each message stored in a message storage slot. Preferably, the newest message gets the lowest age and the oldest message gets the highest age. For example, in a memory 206 capable of storing sixteen messages (i.e., sixteen message storage slots) the age of each of the messages can be represented by the numbers one thru sixteen. If there are five stored messages then the newest message gets age one and the oldest message gets age five. Hence, the messages are assigned a chronological order from one to five, regardless of where they are stored within the sixteen message storage slots in memory 206.

As a new message arrives, the message re-sequencer 230 updates each stored message with a new age, the newest message being assigned the lowest age. In the example above, the message re-sequencer 230 assigns an age of one to a new message and updates the five other stored messages to ages two thru six, respectively. Additionally, when a user deletes a message from a message storage slot, the message re-sequencer updates the "older" stored messages to reflect their change in chronological order. In our example, if a user deletes the message having an age of four then "older" messages aged five and six would be updated to ages four and five, respectively. In this way, the stored messages maintain their relative chronological order, even when new messages are stored or when messages are deleted.

Additionally, each stored message has status information. For example, the status of a stored message may represent at least one of the following: "read message", "unread message", and "protected message". A "read message" status indicates that the user previously read the message. This message is probably a good candidate to delete when the selective call receiver 200 receives a new message and has no empty message storage slot available. A read message therefore has a very low priority. An "unread message" status indicates that the user has not read the message. This indicates a higher priority, since the message has not been read. However, a new message can still overwrite the unread message under certain circumstance. Finally, a "protected message" status indicates that the user does not want a new message to overwrite this protected message. This is the highest priority for a stored message in this example. Furthermore, other status may be assigned to stored messages that may provide utility to a user. For example, stored messages may be assigned a "page type", such as "display", "tone only", or "stored voice".

Also, stored messages may be assigned communication status, such as "duplicated message", "sequential-lockout message", and "message contains errors". A "duplicated message" status indicates that the same message was received more than once. A "sequential-lockout message" status indicates that the selective call receiver will not receive and store duplicates of this message, even if it detects the duplicate pages being transmitted. Lastly, "message contains errors" is self explanatory. Even with some errors, certain messages can be received and presented to the user. However, the status information affirmatively warns the user that the particular message contains errors.

A special type of message status is "timed activation event". This indicates to the user that the message is associated with a timer in the selective call receiver 200. The controller 205 may comprise a timer module (not shown) that keeps track of the timed activation event messages. For example, a timed activation event message may be received and stored without alerting the user. The timed activation event message alerts the user at some later time. This can inhibit the selective call receiver from distrubing the user during a specified time interval, such as during predetermined sleeping hours. In another example, the selective call receiver 200 presents the timed activation event message at a later time via a printer (not shown). The user gets a hardcopy printout of the stored message after a predetermined time interval.

As seen hereinabove, status information can be assigned to the stored messages. This status provides additional information to the user that may be helpful in distinguishing messages and keeping track of messages.

The message re-sequencer 230 maintains the chronological order of the stored messages, and it also organizes the stored messages by status information. However, the message re-sequencer 230 preferably performs the organization by status on certain events. For example, upon a user turing off the selective call receiver 200, a shut-down sequence can invoke the message re-sequencer 230 to organize the stored messages by status categories and by chronological order. Additionally, the message re-sequencer 230 deletes the lowest priority stored messages, having the status of "read message", and updates the "older" stored messages accordingly. This cleans up and organizes the messages that are presented to a user. The selective call receiver presents only the "important" stored messages to the user, organized by status categories and in chronological order. In an alternative example, a user input, such as pressing a button or switch, can also similarly invoke the message re-sequencer 230 as discussed above. This allows the user to reorganize the presentation of stored messages as necessary. Other events may also trigger the message re-sequencing operation, such as receiving a new page. Therefore, the stored messages can be organized by status and by chronological order and presented to the user in such a fashion, as will be more fully discussed below.

Figure 3A:
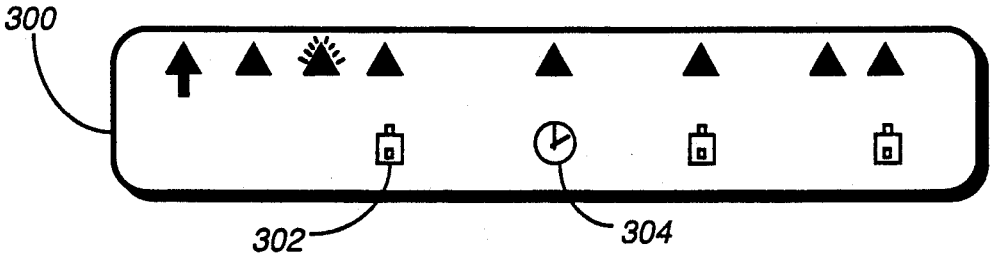
FIGS. 3A, 3B, and 3C show different views of the display of the selective call receiver of FIG. 2 according to an embodiment of the present invention.
Figure 3B:
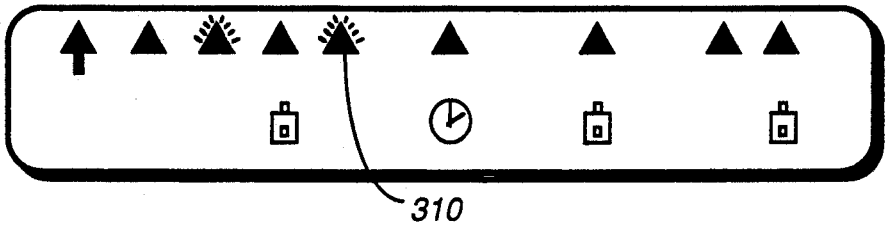
Figure 3C:
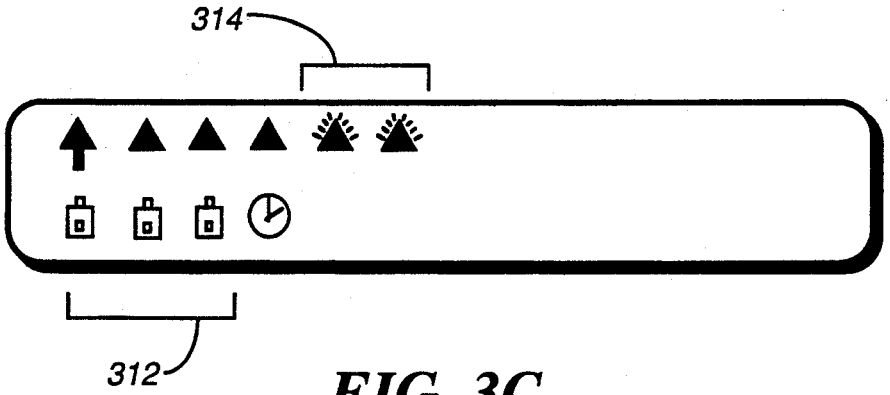

Referring to FIGS. 3A, 3B, and 3C, different views of the display 208 of the selective call receiver 200 are shown, according to an embodiment of the present invention. An exemplary display screen 300 shows twelve message indicator positions for twelve message storage slots. Icons also convey status information, such as a lock 302 to indicate a protected message and a clock 304 to indicate a time activation event message. The display screen 300 typically indicates chronological order from left to right. However, as the user deletes messages and as new messages are stored, such as shown by the unread message indicator 310, the chronological order can be corrupted, as shown in FIG. 3B. The new message is stored in the next available message storage slot.

When the user enters a user input, via the user input controls 209, the stored messages and the corresponding message indicators on the display screen 300 are reorganized by status and re-sequenced by chronological order, as shown in FIG. 3C. The status categories in this example include from highest priority to lowest priority: "protected message", "timed activation event message", "unread message", and "read message". The protected messages 312 are organized at the left-most positions on the display screen 300. The timed activation event message follows the protected messages 312. Lastly, the unread messages 314 follow the timed activation event message. Within each of the message status categories, the messages are then sequenced in chronological order. That is, within the protected messages 312, and similarly for the unread messages 314, the right-most message indicator is the most recently stored message. In this example, the re-sequencing operation also deletes the "old" read messages to "clean up" the display screen 300. This is an optional feature which may further assist the user by removing "old" unwanted messages. Alternatively, any read messages could be organized after the group of unread messages 314.

Subsequently, the user can enter user inputs into the selective call receiver to sequence through the messages in the particular sequence presented to the user (e.g., sequencing through the message indicators from left to right). Therefore, the selective call receiver presents messages to the user in a sequential order prioritized first by the status and then by the chronological order.

Figure 4A:
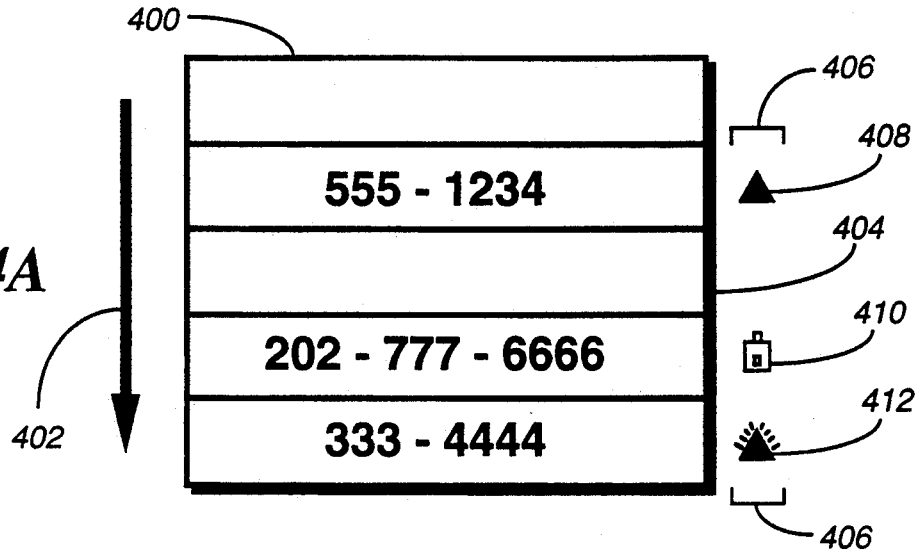
FIGS. 4A, 4B, and 4C show a logical representation of storing and presenting messages to a user of a numeric display message pager in accordance with a first alternative embodiment of the present invention.
Figure 4B:
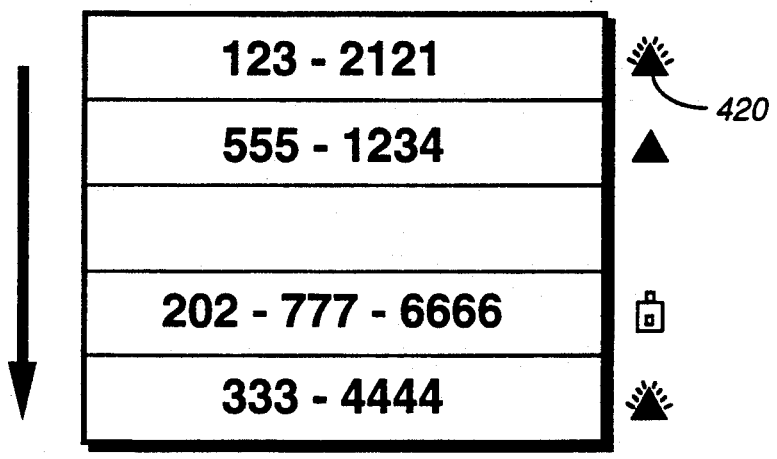
Figure 4C:
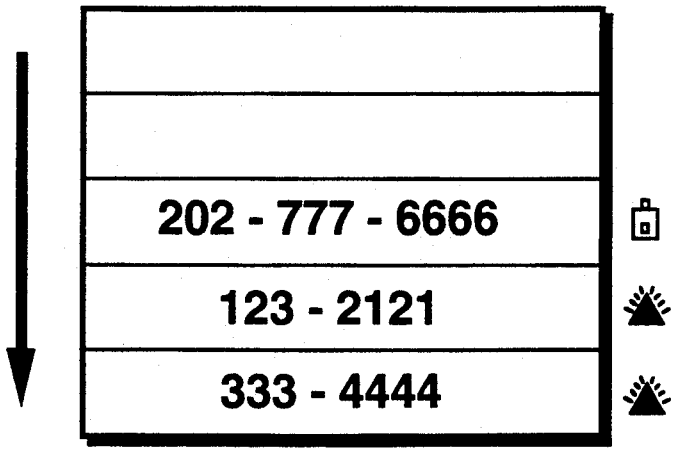

This method of presenting messages to the user can also be applied to a numeric display message pager. FIGS. 4A, 4B, and 4C show a logical representation of storing and presenting messages to a user of a numeric display message pager in accordance with a first alternative embodiment of the present invention. As an example, five message storage slots 400 can store a maximum of five numeric display messages. These messages are presented to the user in reverse chronological order 402. They arrive and are stored in the next available message storage slots from bottom to top. But, they are displayed from top to bottom 402.

The messages have status assigned to them 406, including read message 408, protected message 410, and unread message 412. These message indicators 406 are shown for illustrative purposes and are not normally presented to the user in a display screen.

The user can delete a particular message 404, which leaves a gap 404 (i.e., an empty message storage slot) between the other stored messages. The selective call receiver stores new messages at the next available message storage slot 420, following the "bottom to top" sequence. In this way, the selective call receiver attempts to present the messages to the user in a last-in-first-out chronological order 402. As shown in FIG. 4B, the stored messages can become disorganized, both in status categories and in chronological order. The next new message received and stored would fill message storage slot number three, thereby corrupting the chronological order of the messages being presented.

According to the present invention, the user can press a button, for example, and cause the stored messages to be re-sequenced. This resulting sequence is shown in FIG. 4C. In this example, preferably the re-sequencing or clean up operation also deletes the "read messages". This may further assist the user in keeping track of messages by removing "old" unwanted messages. The selective call receiver, after the re-sequencing operation, presents the stored messages to the user in a logical sequence, prioritized first by the status and then by the chronological order.

Figure 5A:
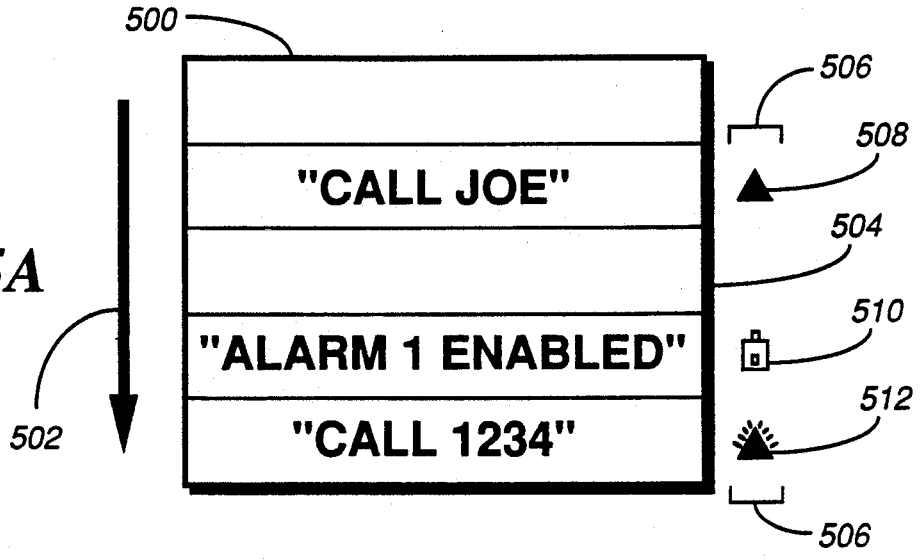
FIGS. 5A, 5B, and 5C show a logical representation of storing and presenting voice messages to a user of a stored voice message pager in accordance with a second alternative embodiment of the present invention.
Figure 5B:
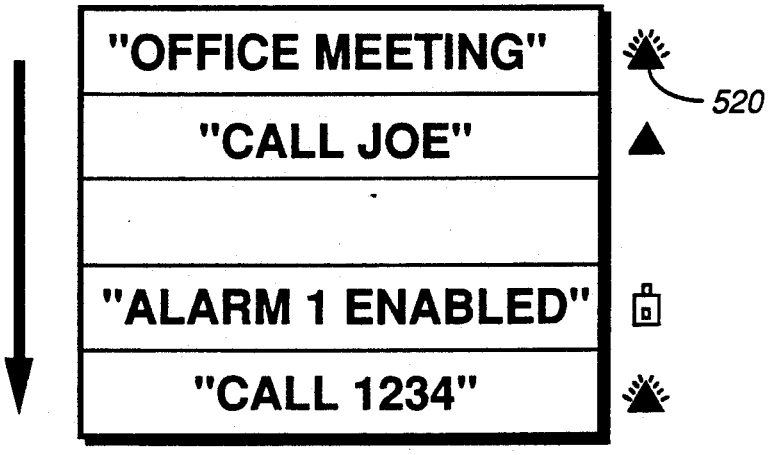
Figure 5C:
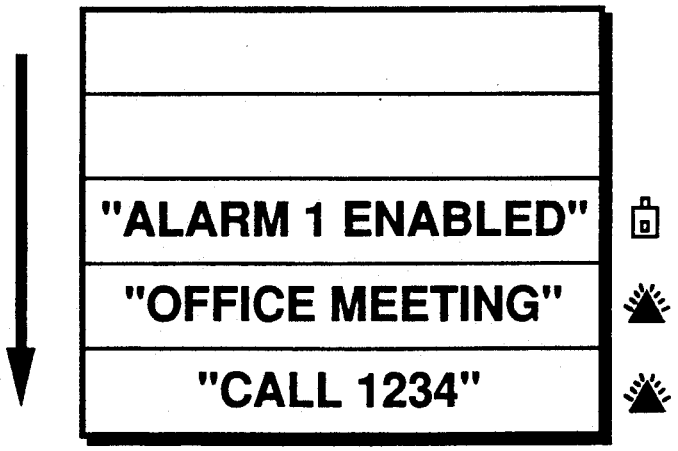

This method of presenting messages can be equally successful when applied to stored voice messages. FIGS. 5A, 5B, and 5C show a logical representation of storing and presenting voice messages to a user of a stored voice message pager in accordance with a second alternative embodiment of the present invention. As an example, five message storage slots 500 can store a maximum of five stored voice messages. These messages are presented to the user in reverse chronological order 502. They arrive and are stored in the next available message storage slots from bottom to top. But, they are presented to the user from top to bottom 502.

Similar to the previous example, these messages can have status information 506. For example, the stored voice message "CALL JOE" is a "read message" 508. That is, the user previously heard the voice message. As discussed earlier, the user may be presented with the voice message as it is being received, or the user can request a playback of the voice message at a subsequent time. This is normally done by pressing a button on the selective call receiver. In either case, the stored voice message is a "read message" 508.

The stored voice messages can also be "protected message" status 510 and "unread message" status 512. Message status in a voice pager can be indicated by an alert indicator, such as the audible alert indicator device 210, the visual alert indicator device 211, and/or the vibratory alert indicator device 212 of FIG. 2. However, where the selective call receiver comprises a display 208, the selective call receiver preferably conveys status information and chronological order to the user via the display 208.

The user can delete a particular stored voice message 504, which leaves a gap 504 (i.e., an empty message storage slot) between the other stored messages. The selective call receiver stores new voice messages at the next available message storage slot 520, following the "bottom to top" sequence. In this way, the selective call receiver attempts to present the stored voice messages to the user in a last-in-first-out chronological order 502. As shown in FIG. 5B, the stored voice messages can become disorganized, both in status categories and in chronological order. The next new voice message received and stored would fill message storage slot number three, thereby corrupting the chronological order of the voice messages being presented.

According to the present invention, the user can press a button, for example, and cause the stored voice messages to be re-sequenced. This resulting sequence is shown in FIG. 5C. In this example, the re-sequencing or clean up operation also deletes the "read message" 508. This may further assist the user in keeping track of messages by removing "old" unwanted messages. Consequently, the selective call receiver, after the re-sequencing operation, presents the stored voice messages to the user in a logical sequence, prioritized first by the status and then by the chronological order. Notice that FIG. 5C shows new message "OFFICE MEETING" being presented before the older message "CALL 1234". Further, the "protected message" status message comes before the two "unread message" status messages.

Figure 7A:
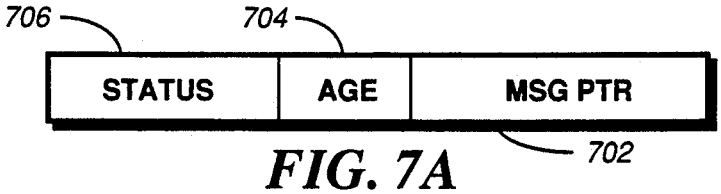
FIGS. 7A, 7B, 7C illustrate exemplary data structures in memory for storing and presenting messages to a user of the selective call receiver of FIG. 2 in accordance with the present invention.
Figure 7B:
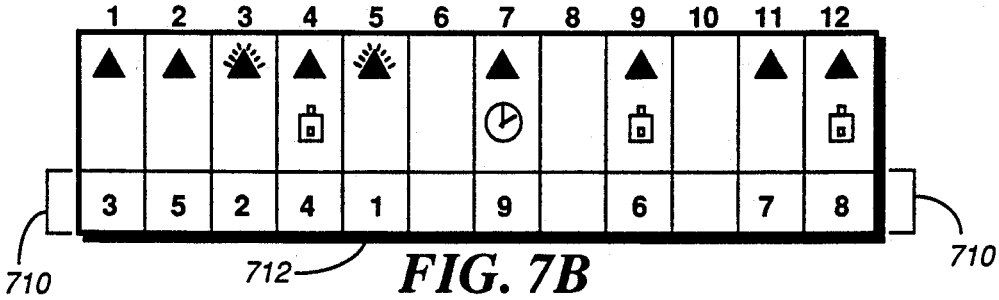
Figure 7C:
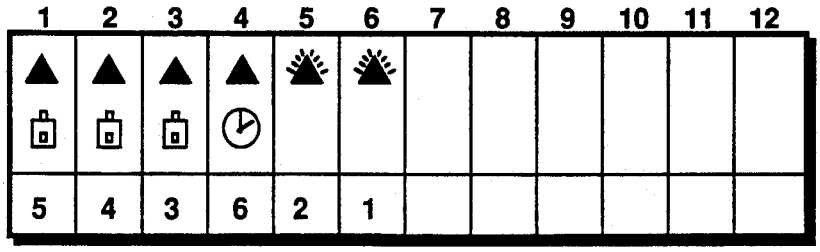
Figure 6:
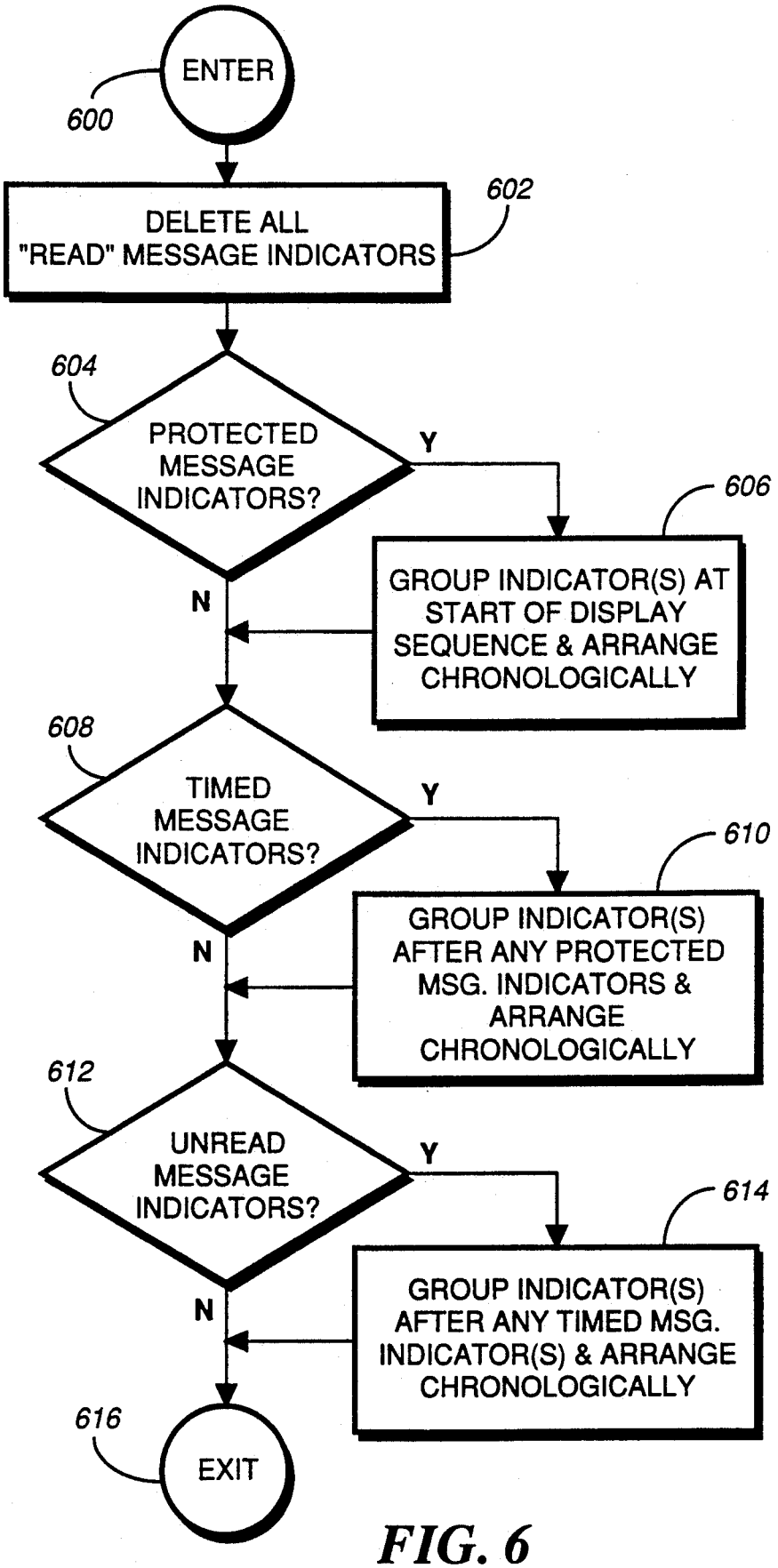
FIG. 6 is a flow diagram for the selective call receiver of FIG. 2 in accordance with the present invention.

As an operational example, refer to FIGS. 6, 7, 2, and 3, as follows. FIG. 6 shows an exemplary flow diagram for the selective call receiver 200 of FIG. 2. It illustrates a re-sequencing "clean up" operation being performed. FIGS. 7A, 7B, 7C illustrate exemplary data structures in memory 206 for storing and presenting messages to a user of the selective call receiver 200. Lastly, FIG. 3B corresponds to the status and chronological information stored in the data structure as shown in FIG. 7B, and FIG. 3C corresponds to the data structure as shown in FIG. 7C.

FIG. 7A shows the three pieces of information that are maintained for each stored message. A message pointer 702 points to the associated message information. Along with the message pointer 702 are the age 704 and the status 706 of the respective message. These three pieces of information constitute a message record (i.e., three fields of a record), identifying the current status of the message 706, the age of the message 704, and the location of the message information 702 in memory 206. Further, the actual message information does not have to move to re-sequence the messages. Only the message records, that is the pointers to the message information, are re-sequenced in this implementation.

In this example, twelve message records are maintained as shown in FIGS. 7B and 7C. Each message record corresponds to a message indicator on the display screen 300 as shown in FIGS. 3B and 3C.

FIGS. 7B and 7C show only the age field 710 and the status field. The message stored in message storage slot five is the most recent message, which is currently unread. Therefore, its age is one 712 and its message indicator is blinking 310 (see FIG. 3B).

Upon invoking a message re-sequencing operation, such as when a user presses a button or turns off the selective call receiver 200, the message re-sequencer 230 deletes all the "read message" status messages and removes the corresponding message indicators 600, 602 (see FIG. 6). This operation removes the pointers to the messages, thereby deleting the messages in memory 206. Further, the message re-sequencer 230 updates the age 710 of the "older" message records as it deletes each "read message" record. For example, the timed activation event message stored in message storage slot seven in FIG. 7B is the oldest message, its age being nine. After the delete "read message" operation 602 its age is six, as shown in FIG. 7C.

Then, the message re-sequencer 230 groups the remaining message records by status and then by chronological order. First, the "protected message" records are grouped together, and arranged in chronological order within the group 604, 606. Then, the timed activation event message is located after the "protected message" records 608, 610. Finally, the "unread message" records are grouped together, and arranged in chronological order within the group 612, 614, 616. The resulting message records representing the message storage slots are shown in FIG. 7C. The corresponding message indicators are shown being presented to a user in FIG. 3C. Therefore, the user can sequence through the messages in a logical fashion, being organized first by message status category and then by chronological order.

Thus, this method for presenting stored messages enables a selective call receiver user to quickly and easily determine the time priority and the organization of the messages stored in memory. Further, by displaying message indicators arranged in a sequential order prioritized first by status and then by chronological order, the user can more easily keep track of stored messages and can sequence through the stored messages in a logical and easy to follow method.

What is claimed is:

1. A selective call receiver, comprising:

a receiver for selectively receiving messages;

a memory coupled to the receiver for storing the messages;

means coupled to the memory and to the receiver for assigning a chronological order to each of the messages stored in the memory based on an order in which the messages are received, and also for assigning a status designation, other than the chronological order, to the messages, and further for prioritizing the messages in a sequential order being prioritized first by a priority of the status designation assigned to the messages and then further prioritized therewithin according to the chronological order assigned to the messages; and means coupled to the memory for displaying message indicators to a user to represent the messages stored in the memory, the displayed message indicators capable of being organized to represent the sequential order for the messages.

2. The selective call receiver of claim 1, wherein the status designation assigned to each of the messages is at least one of a set of status categories including "read message", "unread message", "protected message", "page type", "timed activation event", "duplicated message", "sequential-lockout message", and "message contains errors".

3. The selective call receiver of claim 1, further comprising:

user input control means for accepting user input, and wherein the displaying means is responsive to the user input for displaying the messages to a user of the selective call receiver according to the sequential order for the messages represented by the message indicators.

4. The selective call receiver of claim 1, wherein the assigning means is responsive to the receiver for assigning status designation and chronological order to the messages in response to receiving the messages.

5. The selective call receiver of claim 1, further comprising a message re-sequencer coupled to the assigning means and the memory for re-sequencing the status designation and the chronological order assigned to the messages stored in the memory according to the sequential order for prioritizing the messages first by the status designation and then further prioritizing therewithin according to the chronological order assigned to the messages, the displaying means displaying the message indicators to the user to represent the messages according to the sequential order assigned thereto by the message re-sequencer.

6. The selective call receiver of claim 5, further comprising user input control means coupled to the message re-sequencer for invoking the message re-sequencer in response to a user input, the displaying means displaying the message indicators to the user to represent the messages according to the sequential order assigned thereto by the message re-sequencer.

7. The selective call receiver of claim 5, wherein the message re-sequencer is responsive to the receiver for re-sequencing the status designation and the chronological order of the stored messages in response to a message being received, the displaying means displaying the message indicators to the user to represent the messages according to the sequential order assigned thereto by the message re-sequencer.

8. The selective call receiver of claim 5, wherein the message re-sequencer is invoked in response to the selective call receiver being turned off.

9. A method for representing stored messages to a user of a selective call receiver, comprising the steps of:

receiving messages;

storing messages;

assigning a chronological order to each of the stored messages based on an order in which the messages are received;

assigning at least one status designation, other than the chronological order, to each of the stored messages;

prioritizing the stored messages in a sequential order according to first a priority of the status designation assigned to the messages and then further a priority therewithin according to the chronological order assigned to the messages; and displaying message indicators on a display screen to represent the messages, the message indicators being organized in the sequential order to represent the sequential order priority of the stored messages to a user.

10. The method of claim 9, wherein the displaying step comprises the step of displaying the messages in the sequential order represented by the message indicators.

* * * * *